United States Patent [19]

Acheson

[11] 4,348,159

[45] Sep. 7, 1982

[54] CONVERTIBLE PUMP SERVO-VALVE CONTROL

[75] Inventor: John L. Acheson, Franklin, Wis.

[73] Assignee: Rexnord Inc., Milwaukee, Wis.

[21] Appl. No.: 110,041

[22] Filed: Jan. 7, 1980

[51] Int. Cl.[3] ..... F04B 49/08; F04C 15/04

[52] U.S. Cl. ..... 417/220; 418/26; 418/27; 418/31

[58] Field of Search ..... 418/24–27, 418/31; 417/218–222

[56] References Cited

U.S. PATENT DOCUMENTS

| | | | |
|---|---|---|---|
| 2,894,458 | 7/1959 | Hallman | 418/27 |
| 2,975,717 | 3/1961 | Rynders et al. | 418/26 |
| 3,549,281 | 12/1970 | Schink et al. | 418/31 |
| 3,820,920 | 6/1974 | Klimaszewski et al. | 417/218 |
| 4,158,529 | 6/1979 | Nonnemacher et al. | 417/218 |
| 4,275,758 | 6/1981 | Masuda | 137/489 |

FOREIGN PATENT DOCUMENTS

| | | | |
|---|---|---|---|
| 2600918 | 8/1977 | Fed. Rep. of Germany | 418/26 |

*Primary Examiner*—John J. Vrablik
*Attorney, Agent, or Firm*—Vance A. Smith; Ernst W. Schultz; John M. Neary

[57] ABSTRACT

A vane-type variable displacement pump is controlled by a first stage servo-valve. The servo-valve is controlled by a second stage which may optionally include devices which provide any of several desired control effects.

6 Claims, 10 Drawing Figures

CONVERTIBLE PUMP SERVO-VALVE CONTROL

BACKGROUND OF THE INVENTION

A preferred servo-valve is shown and described in detail in U.S. Pat. No. 3,549,281 which also shows in section a variable displacement vane pump and the two pistons and biasing spring which adjust the position of an outer ring and the displacement of the pump. My copending application Ser. No. 078,332 and filed Sept. 24, 1979 for Servo-Valve Convertible Construction provides a flow control device optionally to be added to such a valve to convert the servo-valve to a load sensing valve which responds to the rate of flow of the pump output rather than pump output pressure. It is an object of the present invention to provide for the convenient and optional further addition of a displacement and torque limiting control which is directly responsive to the position of the pump displacement control means.

SUMMARY OF THE INVENTION

The displacement of a variable displacement pump is varied by a control piston which is operated by hydraulic pressure derived from the pump output and controlled by a first stage servo-valve which in turn is controlled by a pressure responsive control valve and/or a torque control valve which is responsive to pump displacement. The present invention provides for their alternate assembly either with the pressure control valve attached to the torque control valve and the latter attached to the servo-valve, or without the torque control valve and the pressure control valve attached to the servo-valve and for assembly either with or without a flow control device carried by and also controlling the servo-valve.

DESCRIPTION OF THE PREFERRED EMBODIMENT SHOWN IN THE DRAWINGS

Figure 1:
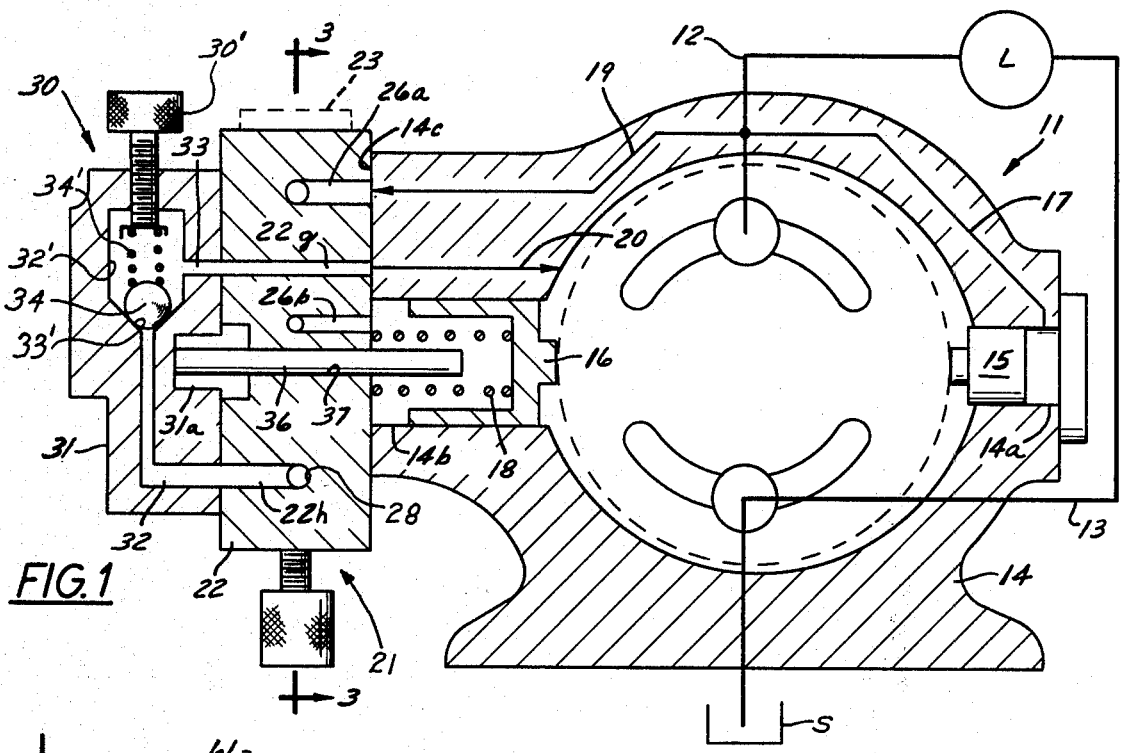
FIG. 1 shows an hydraulic system with the servo-controlled vane pump in section. The rotor and movable ring are not shown. The other parts of the hydraulic system are shown by conventional symbols.

The output of the variable displacement vane-type pump 11 is connected by line 12 to the load L. The return line 13 connects the load L to the pump input and to sump S. The chamber of the pump body 14 is also connected to sump S. The pump rotor, not shown, operates within a ring, shown by a broken line, which is laterally movable within the pump body chamber by the pistons 15 and 16 to vary the displacement of the pump. The closed bore or cylinder **14*a* of pump body 14 carries the piston 15. The line 17 indicates a drilled passage within pump body 14 from line 12 to bore 14*a* whereby the ring is biased by pump output pressure toward the left as shown and in the direction which reduces pump displacement. The spring 18 biases piston 16 in bore 14*b* toward the right as shown. The line 19 indicates a drilled passage within pump body 14 from line 12 to the face 14*c* of the pump body for connection to bore 14*b* as will be described and whereby the pressure in bore 14*b* determines or adjusts the position of the ring and the displacement of pump 11. The pressure referred to is derived from a pilot flow from line 19 and which is returned to sump S by a drilled passage indicated by line 20 from face 14*c*** of the pump body to the pump chamber.

Figure 3:
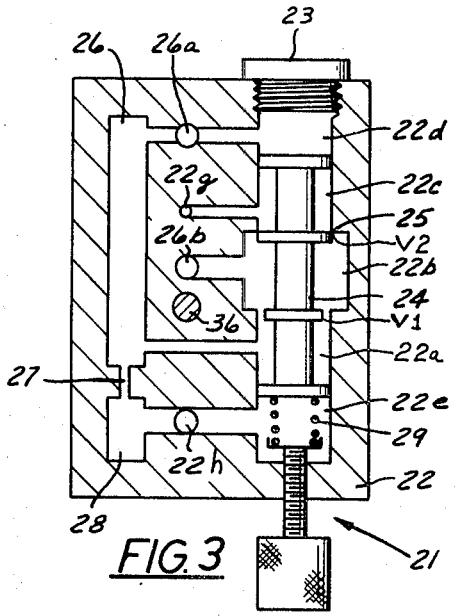
FIG. 3 is a section taken on line 3—3 of FIG. 1 and FIG. 6.
Figure 5:
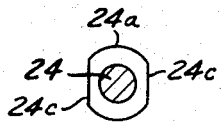
FIG. 5 is a section taken on line 5—5 of FIG. 4 to show the flats of one land of the spool.
Figure 4:
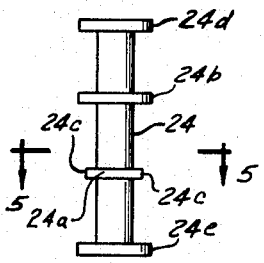
FIG. 4 shows the spool of the servo-valve of FIG. 1.
Figure 2:
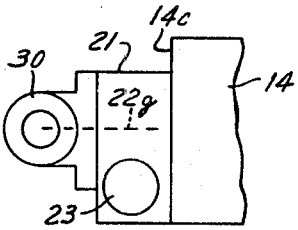
FIG. 2 is a plan view of reduced scale and shows the pressure control valve attached to the servo-valve as in FIG. 1.

As shown in FIG. 3, servo-valve 21 includes the valve body 22 having a bore which is closed at one end by the removable plug 23 and in which the spool 24 is axially movable. With reference to FIGS. 3 and 4, the spool lands **24*a* and 24*b* separate chambers 22*a*, 22*b* and 22*c*. The ends 24*d* and 24*e* of the spool define the end chambers 22*d* and 22*e*. Passages from chamber 22*a* to 22*b* are provided by the flats 24*c* which are shown in FIG. 5. A variable passage is also provided from chamber 22*b* to chamber 22*c* between land 24*b* and the corner of the stepped bore as at 25 (FIG. 3**). The mentioned passages are restricted and will be referred to as restriction V1 and the variable passage will be referred to as restriction V2.

As shown in FIGS. 1 and 3, servo-valve 21 is attached to pump 11 with valve body 22 secured against face **14*c* so that the passages as shown and including passage 26 and passage 26*a* in valve body 22 connect line 19 with chambers 22*a* and 22*d*. Similarly, pump control passage 26*b* and return passage 22*g* respectively connect chamber 22*b* with bore 14*b* and chamber 22*c* with line 20. The restriction 27 connects passage 26 with servo-valve control passage 28 which is connected as shown with chamber 22*e* and passage 22*c* to 22*h***.

As will be further described, chambers **22*c* and 22*d* are connected so that a variable pilot flow from pump 11 normally passes restrictions V1 and V2. Chamber 22*b* is connected to bore 14*b* of pump 11 so that the (control) pressure of the flow intermediate restrictions V1 and V2 operates against the control piston 16. Thus, movement of spool 24 upwardly as shown, closes restriction V2 at step 25** and the control pressure approaches pump output pressure. Conversely, spool movement downwardly opens restriction V2 and the control pressure drops toward the return (or chamber) pressure.

The spring 29 in the chamber **22*e* of valve body 22 biases spool 24** as shown and is manually adjustable externally by the control knob shown.

Chamber **22*a* is connected to chamber 22*e* through the restriction 27 and chamber 22*e* is connected to return line 20 through the adjustable pressure relief valve 30 which is set to establish the pressure which controls movement of spool 24. At start-up and until that pressure is reached, spring 29 holds valve spool 24 upwardly as shown (Position 1, FIG. 9) such that the restriction V2 is closed and the land 24***a* is positioned in chamber 22*b* such that restriction V1 is removed. The pump output pressure from line 19 through chambers 22*a* and 22*b* is applied to piston 16 and pump 11 is held at full stroke. Thereafter, in normal operation spool 24 moves between positions 2 and 3 of FIG. 9.

Pressure relief valve 30 is manually adjustable by a thumb screw 30' and includes the valve body 31 which is secured against valve body 22 so that the inflow passage 32 into a sump chamber 32' registers with passage 22*h* in valve body 22 to communicate with passage 28 and chamber 22*e* (FIGS. 1 and 3). The outflow passage 33 from the sump chamber 32' registers with passage 22*g* extending through valve body 22 and with line 20 (FIG. 1). If or when the pump output pressure exceeds the pressure setting of pressure relief valve 30, the ball valve member 34 in the valve 30 lifts off the valve seat 33' against the force of the biasing spring 34' and the resulting lower pressure in chamber 22*e* relative to the pressure in chamber 22*d* which is maintained by the restriction 27, similarly allows spool 24 to be moved against spring 29 to open restriction V2 as in position 4 of FIG. 9. The maximum output pressure of pump 11 is thus limited by valve 30 which also functions to meter the flow which determines the pressure in chamber 22*e*.

Under normal operating conditions and with spring 29 adjusted as required, the pump output pressure opens valve 30 so that a very small fraction of the pump output is allowed to flow through restriction 17, passages 22*h* and 32 which are in registry and the valve 30 to return through passages 33 and 50*a* which are in registry and to line 20.

Figure 6:
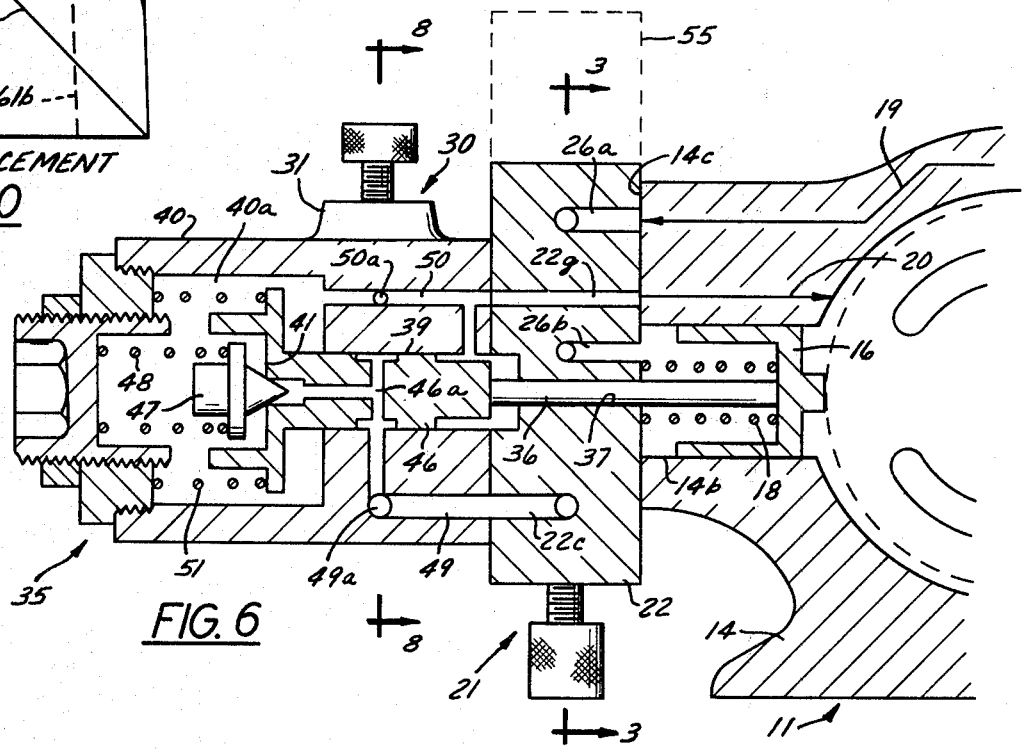
FIG. 6 shows the pump of FIG. 1 in part and with the pressure control valve attached to a torque control valve which has been attached to the servo-valve. The position of the flow control device which has also been added to the servo-valve is shown by broken lines.
Figure 8:
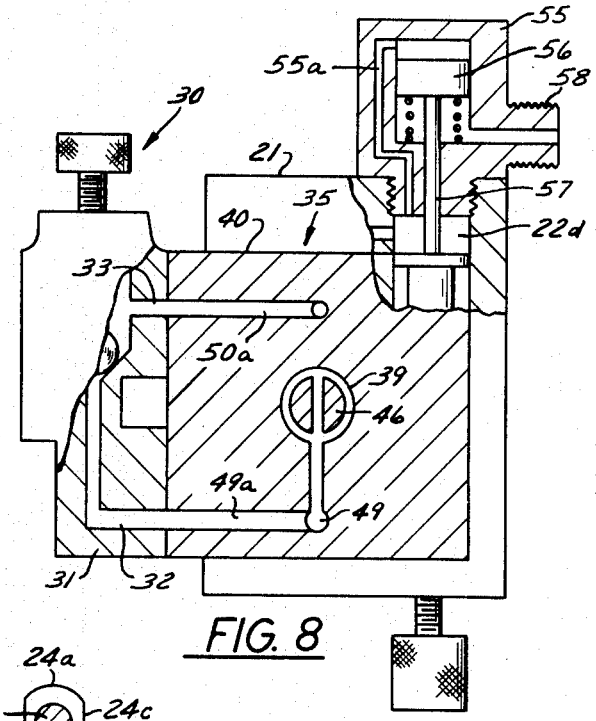
FIG. 8 is a section taken on line 8—8 of FIG. 6. The flow control device and a portion of the servo-valve is shown in section.
Figure 7:
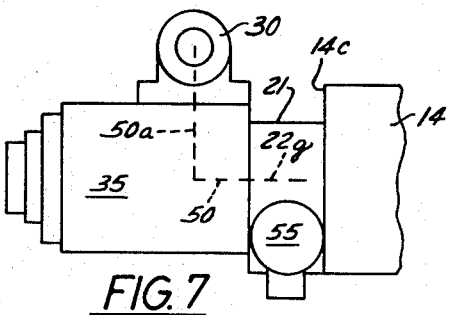
FIG. 7 is of reduced scale and shows in plan the assembly of FIG. 6.

With reference to FIGS. 6–8, pressure relief valve 30 may be replaced directly by the displacement responsive valve 35 and reattached to valve 35 to operate therewith. As will be described, displacement control valve 35 connects chamber 22*e* with line 20 through the manually adjustable pressure relief valve 30 and effects the same control of servo-valve 21. However, valve 35 is adjusted by movement of piston 16 of pump 11 by means of the pin 36 having a sliding fit in the bore 37 of valve body 22. (In the assembly shown in FIG. 1, pin 36 is not required. Alternatively, the pin may be disposed as shown in an inactive position with one end projecting into the recess 31*a* which registers with bore 37.) As shown in FIG. 6, pin 36 is positioned with one end of the pin extending into the bore 39 of valve body 40 and with the other end of pin 36 projecting into bore 14*b* so that it is engageable by piston 16. The movable valve seat 41 in chamber 40*a* of the valve body 40 is carried by plunger 46 which is axially movable in bore 39 of body 40.

Movement of piston 16 to the left as shown in FIG. 6 is effected by piston 15 and causes pin 36 to push the plunger 46 in bore 39 so that the needle 47 is more firmly held by spring 48 against the valve seat 41 which includes one end of the passage 46*a* in plunger 46. As shown in FIG. 6, the other end of passage 46*a* opens into an annular recess formed in the plunger and which maintains communication with the inflow passage 49.

The position of spring 48 is adjusted by an adjustment screw as shown. The movement of piston 16 to the right as shown allows plunger 46 to move to the right and opens passage communication through passage 46*a*, past the valve 47, and into the chamber 40*a* of valve body 40. Such opening of displacement valve 35 allows the flow of fluid from chamber 22*e* through passage 22*c* and 49 into chamber 40*a* from where it is discharged through passage 50 which registers with passage 22*g* and returns through line 20. Spring 51 within chamber 40*a* of valve body 40 holds plunger 46 against pin 36 and the latter against piston 16 and does not have a control function as such.

Figure 10:
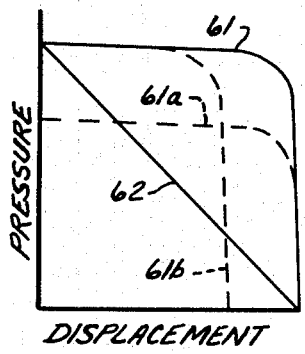
FIG. 10 is a graph showing the controlled characteristics of the pump with the controls of FIGS. 1 and 6.

The control of pump displacement in relation to pump output pressure is shown graphically in FIG. 10. Curve 61 shows the maximum pump displacement and pressure and curve 61*a* is a selected pressure limit as established by valve 30. Line 62 shows a typical reduction in pump displacement as output pressure increases and vice-versa, as effected by valve 35 up to the limit of valve 30. The slope of line 62 is determined by the spring rate of spring 48.

Figure 9:
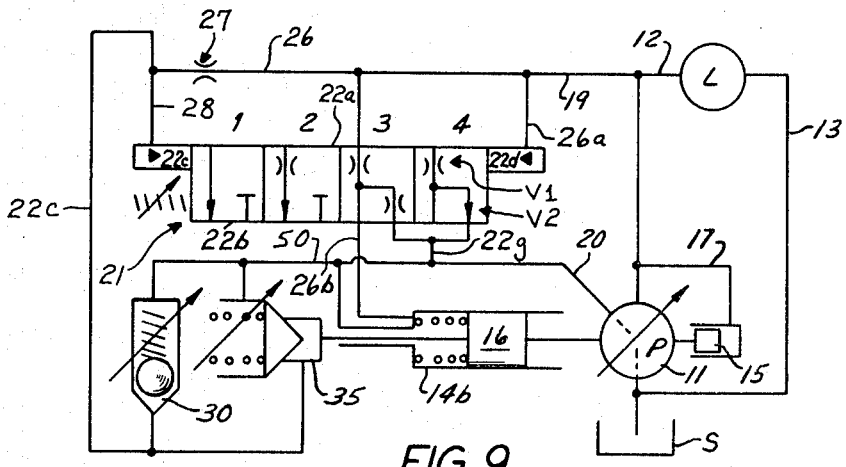
FIG. 9 shows diagrammatically the operation of the assembly of FIG. 6.

As shown, pressure relief valve 30 is attached to valve body 40 so that the branch 49*a* of inflow passage 49 registers with inflow passage 32 and outflow passage 33 registers with the branch 50*a* of passage 50 whereby valves 30 and 35 are in parallel operation as shown in FIG. 9. The various passages as shown and described are drilled and closed as required by plugs, not shown. The valve bodies are, of course, secured by bolts, not shown, and the present invention permits the control of pump 11 to be changed readily as desired and with a minimum of time and effort.

In accordance with my copending application Ser. No. 078,332 the servo-valve 21 may also be optionally fitted with the flow sensing control device 55. As shown in FIGS. 6–8, it may be employed also be optionally fitted with the flow sensing control device 55. As shown in FIGS. 6–8, it may be employed also with the displacement control valve 35. The device replaces plug 23 and includes the spring biased piston 56 and pin 57 which limits movement of spool 24 in one direction so as to limit pump displacement and in effect govern load speed fluid under pressure in chamber 22*d* through passage 55*a* moves piston 56 in the other direction and the flow control pressure is provided by a line, not shown, which is connected to the threaded fitting 58. The details of operation of the flow control device is disclosed in my copending application. Curve 61*b* of FIG. 10 shows the displacement limit which may be effected by the flow control device 55.

I Claim:

1. A control system for a variable displacement pump having a body provided with an output port and a supply port, and a piston disposed in a control cylinder and movable under pressure therein, said piston operatively controlling the position of a pump displacement control device such that an increase in pressure acting on said piston tends to increase the pump displacement and vice versa, said system comprising:

a servo-valve having a body provided with an output pressure passage communicating with said pump output port, a pump control passage communicating with said control cylinder, a servo-valve control passage communicating with said output pressure passage through a restriction, a return passage communicating with said pump supply port, and a servo-valve member movable in a servo-valve bore in response providing a pump control pressure which is derived from a pilot flow through and varied by said servo-valve member and which is increased as said pressure differential decreases and vice versa;

means allowing and controlling a return flow of a fraction of the pump output through said restriction, including a spring biased displacement control valve having a body attached to said servo-valve body, means for coupling said pump piston and said control valve such that movement of the latter in the direction which decreases pump displacement increases the spring bias of said control valve and vice versa, said means further including a spring biased pressure relief valve having a body attached to said displacement control valve body, said valve bodies having a series of interconnected passages providing for said return flow of a fraction of the pump output through said restriction and both the displacement control valve and the pressure relief valve in parallel whereby pump displacement is caused to vary inversely with pump output pressure.

2. The control system defined in claim 1, wherein the interconnection of the passages of the servo-valve body and of the displacement control valve body are provided by the direct registry of said passages, and the interconnection of the passages of the displacement control valve body and pressure relief valve body are provided by their direct and similar registry, whereby the displacement control valve may be detached from the servo-control valve body and the pressure relief valve may be operatively attached directly to the servo-control valve to comprise said means where pump output pressure need only be limited by the return flow of the fraction of the pump output allowed through the pressure relief valve.

3. In combination with a variable displacement pump having a body provided with a bore and a piston movable by the pressure in said bore such that an increase in pressure in said bore increases pump displacement and vice versa, a servo-valve having a body provided with a pump output passage connected to the pump output, a pump control passage communicating with said bore of the pump body, a servo-valve control passage connected to said pump output passage through a restriction in the servo-valve body, a return passage connected to the pump supply, and means allowing and controlling a return flow of a fraction of the pump output through said restriction, the servo-valve being responsive to the pressure differential across said restriction and providing a pump control pressure which is derived from a pilot flow through and varied by said servo-valve and which pump control pressure is increased by said servo-valve as said pressure differential decreases and vice versa;

said means including a spring biased displacement control valve having a body attached to the servo-valve body and having a control rod supported by and extending through the servo-valve body between the pump piston and said control valve such that movement of said piston in the direction which decreases pump displacement increases the spring bias of said control valve and vice versa, and a spring biased pressure relief valve having a body attached to the body of the displacement control valve, said valve bodies having a series of interconnected passages providing for said return flow of a fraction of the pump output (a) through said restriction and said displacement control valve up to the setting of said pressure relief valve and (b) through said restriction and both the displacement control valve and the pressure relief valve in parallel at and above said setting whereby pump displacement is caused to vary inversely with pump output pressure up to the limit of said pressure relief valve.

4. In the combination of claim 3, the interconnection of the passages of the servo-valve and of the displacement control valve being provided by their direct registry and the interconnection of the passages of the displacement control and pressure relief valves being provided by their direct and similar registry whereby the displacement control valve may be detached from the servo-control valve body and the pressure relief valve may be operatively attached directly to the servo-control valve to comprise said means where pump output pressure need only be limited by the return flow of the fraction of the pump output allowed through the pressure relief valve.

5. In a variable displacement pump having a low pressure inlet (20) and a high pressure outlet (12), and having a control piston (16) mounted in a cylinder (**14*b***) in said pump and movable in said cylinder under the influence of fluid pressure in said cylinder to change the displacement of said pump, the improvement comprising a hydraulic control system for controlling the hydraulic fluid pressure in said cylinder, including:

a servo-valve (21) having a body (22) provided with a valve member (24) movably mounted in a valve bore;

a control passage (**26*b*) hydraulically communicating between said cylinder (14*b*) and a piston control chamber (22*b***) in said valve bore;

inflow (24a) and outflow (**24*b*) valve flow control surfaces on said valve member (24**) for controlling the flow of fluid into and out of said control chamber, respectively;

first (**24*d*) and second (24*e*) fluid pressure responsive surfaces on said valve member (24**) for moving said valve member in response to the pressure differential across said fluid pressure responsive surfaces;

a first sump chamber (**22*c*) in said valve bore on the side of said outflow valve flow control surface (24*b***) opposite said control chamber;

a first return passage (**20,22*g*) hydraulically communicating between said first sump chamber (22*c*) and said pump inlet (20**);

a reference chamber (**22*a***) in said valve bore on the side of said inflow valve flow control surface opposite said control chamber;

a supply pressure passage (**19, 26*a*) hydraulically communicating between said pump outlet (12) and said reference chamber (22*a***);

first (**22*d*) and second (22*e***) servo-valve control chambers in said valve bore on the sides of said first and second fluid pressure responsive surfaces opposite said sump chamber and said reference chamber, respectively;

a first adjustable pressure relief valve (35) having a body (40) and a plunger (46) slidably mounted in said body;

a mechanical coupling (36) between said plunger (46) and said piston (16);

a second sump chamber (**40*a*) in said first adjustable pressure relief valve body (40**);

a first pressure relief passage (46*a*) in said plunger (46) hydraulically communicating between said second servo-valve control chamber (22*e*) and said second sump chamber (40*a*) at first valve seat (41);

a first pressure relief valve member (47) in said second sump chamber (40*a*) for controlling the flow of fluid from said second servo-valve control chamber (22*e*) through said pressure relief passage (46*a*) to said second sump chamber (40*a*);

means (48) for biasing said first pressure relief valve member (47) against said first valve seat (41) and for urging said piston toward its high displacement position through said plunger (46) and said mechanical coupling (36);

a second return passage (50) hydraulically communicating between said second sump chamber (40*a*) and said pump inlet (20);

a second adjustable pressure relief valve (30) having a body (31) defining therein a third sump chamber (32');

a second pressure relief passage (32) in said second pressure relief valve body (31) hydraulically communicating between said third sump chamber (32') at a second valve seat 33' and said second servo-valve control chamber (22*e*);

a second pressure relief valve member (34) in said third sump chamber (33') for controlling the passage of fluid from said second servo-valve control chamber (22*e*) to said third sump chamber (33'); and means (30',34') for adjustably biasing said second pressure relief valve member (34) against said second valve seat (33');

whereby movement of said control piston (16) in the direction which decreases pump displacement increases the spring bias of said first pressure relief valve member (47) against said first valve seat (41) so that the pump output pressure necessary to effect a decrease in pump displacement decreases as pump output pressure decreases, by which the pump displacement can be made a linear function of pump pressure and the input torque is thereby maintained at or below a constant preset valve.

6. The hydraulic control system defined in claim 5, wherein the interconnection of said servo-valve body passages and of said first adjustable pressure relief valve body passages are provided by their direct registry, and the interconnection of said first adjustable pressure relief valve body passage and said second pressure relief valve body passages are provided by their direct and similar registry, whereby the first adjustable pressure relief valve body may be detached from the servo-valve body, and the second pressure relief valve body may be operatively attached directly to the servo-valve body to provide a control system in which the pump output pressure need be limited only by the return flow of the fraction of the pump output allowed through the pressure relief valve.

* * * * *